US005273684A

United States Patent [19]

Traber et al.

[11] Patent Number: 5,273,684

[45] Date of Patent: Dec. 28, 1993

[54] COMPOSITION FOR WETTING HYDROPHOBIC CAPILLARY MATERIALS AND THE USE THEREOF

[75] Inventors: Rainer H. Traber, Basel; Christian Guth, Birsfelden, both of Switzerland

[73] Assignee: Ciba-Geigy Corporation, Ardsley, N.Y.

[21] Appl. No.: 35,522

[22] Filed: Mar. 23, 1993

Related U.S. Application Data

[63] Continuation of Ser. No. 747,460, Aug. 12, 1991, abandoned, which is a continuation of Ser. No. 384,899, Jul. 24, 1989, abandoned.

[30] Foreign Application Priority Data

Jul. 27, 1988 [CH] Switzerland ..... 2852/88
Aug. 23, 1988 [CH] Switzerland ..... 3121/88

[51] Int. Cl.[5] ..... B01F 17/02; B01F 17/44; D06M 13/224; D06M 13/244

[52] U.S. Cl. ..... 252/353; 252/355; 252/356; 252/357; 252/8.6; 264/343

[58] Field of Search ..... 252/353, 355, 356, 357, 252/312, 364, 8.6, 8.8; 264/343

[56] References Cited

U.S. PATENT DOCUMENTS

| | | | |
|---|---|---|---|
| 2,205,042 | 6/1940 | Lenher et al. | 8/492 X |
| 2,676,896 | 4/1954 | Cohen et al. | 428/253 |
| 3,346,598 | 10/1967 | Volkenburgh et al. | 252/356 X |
| 3,396,121 | 8/1968 | Miksch et al. | 252/356 X |
| 3,436,250 | 4/1969 | Yamaguchi et al. | 427/394 |
| 4,071,468 | 1/1978 | Abel et al. | 252/356 X |
| 4,201,803 | 5/1980 | DePaolo | 427/381 |

FOREIGN PATENT DOCUMENTS

| | | |
|---|---|---|
| 856381 | 12/1960 | United Kingdom . |
| 898500 | 6/1962 | United Kingdom . |

OTHER PUBLICATIONS

Swiss Reports.

*Primary Examiner*—Robert L. Stoll
*Assistant Examiner*—Daniel S. Metzmaier
*Attorney, Agent, or Firm*—Kevin T. Mansfield; Edward McC.Roberts

[57] ABSTRACT

There are disclosed compositions for wetting hydrophobic capillary materials, which compositions contain, in addition to a water-soluble anionic, cationic or amphoteric surfactant or a mixture thereof, an amphiphilic, phosphorus-free organic compound which is very slightly soluble in water, has a melting point below 4° C., and a boiling point above 200° C.

8 Claims, No Drawings

COMPOSITION FOR WETTING HYDROPHOBIC CAPILLARY MATERIALS AND THE USE THEREOF

This application is a continuation of application Ser. No. 07,747,460, filed Aug. 12, 1991, abandoned which is a continuation of 07/384,899 filed Feb. 24, 1989.

The present invention relates to a novel composition and to the use thereof for wetting hydrophobic capillary materials so as to effect an almost complete deaeration of said materials in addition to a rapid wetting.

The composition of this invention for wetting hydrophobic capillary materials comprises a water-soluble surfactant and an amphiphilic, phosphorus-free organic compound which is very slightly soluble in water and has a melting point below 40° C. and a boiling point above 200° C. (at 1013 hPa).

Preferred concurrently used amphiphilic phosphorus-free compounds in the practice of this invention are liquid.

Suitable amphiphilic organic compounds which are very slightly soluble in water are, for example, trialkyl esters of aliphatic hydroxytricarboxylic acids or acetylated hydroxytricarboxylic acids containing 4 to 8 carbon atoms in each of the alkyl moieties, for example tributyl citrate and acetyl tributyl citrate; tetraalkylureas containing 4 to 8 carbon atoms in each of the alkyl moieties, such as preferably tetrabutyl urea, di- or trialkylamines containing 4 to 10 carbon atoms in each of the alkyl moieties, such as preferably bis(2-etbylbexyl)amine or tributylamine; bis(alkylamino)alkanols containing 4 to 8 carbon atoms in each of the alkyl moieties, such as preferably 2-dibutylaminoethanol, or alcohols of acyclic terpenes, such as preferably geraniol. Mixtures of these compounds may also be used.

Throughout this specification, the term "very slightly soluble in water" will be understood as referring to an organic liquid, one part of which dissolves in 1,000 to 10,000 parts of water at 20° C. (q.v. Martindale, The Extra Pharmacopeia, 28th edition, London, The Pharmaceutical Press, 1982, Xiii).

The surfactants may be anionic, cationic, amphoteric or, preferably, non-ionic surfactants. They may be used singly or as mixtures.

Examples of suitable anionic surfactants are:

sulfated aliphatic alcohols which contain 8 to 18 carbon atoms in the alkyl chain, e.g. sulfated lauryl alcohol;

sulfated unsaturated fatty acids or fatty acid lower alkyl esters which contain 8 to 20 carbon atoms in the fatty radical, e.g. ricinolic acid and oils containing such fatty acids, e.g. castor oil;

alkylsulfonates containing 8 to 20 carbon atoms in the alkyl chain, e.g. dodecylsulfonate;

alkylarylsulfonates with linear or branched alkyl chain containing not less than 6 carbon atoms, e.g. dodecylbenzenesulfonates or 3,7-diisobutylnaphthalenesulfonates;

sulfonates of polycarboxylates, for example dioctyl sulfosuccinate or sulfosuccinimides;

the alkali metal salts, ammonium salts or amine salts of fatty acids containing 10 to 20 carbon atoms, e.g. rosin salts, classified as soaps;

esters of polyalcohols, especially mono- or diglycerides of fatty acids containing 12 to 18 carbon atoms, e.g. monoglycerides of lauric, stearic or oleic acid; and the adducts of 1 to 60 moles of ethylene oxide and/or propylene oxide with fatty amines, fatty acids or fatty alcohols, each containing 8 to 22 carbon atoms, with alkylphenols containing 4 to 16 carbon atoms in the alkyl chain, or with tribydric to bexahydric alkanols containing 3 to 6 carbon atoms, which adducts are converted into an acid ester with an organic dicarboxylic acid, e.g. maleic acid or sulfosuccinic acid, but preferably with an inorganic polybasic acid such as o-pbosphoric acid or sulfuric acid.

Further suitable anionic surfactants are derivatives of alkylene oxide adducts, e.g. adducts of alkylene oxides, preferably of ethylene oxide and/or propylene oxide or also styrene oxide, with organic hydroxyl, carboxyll amino and/or amido compounds containing aliphatic hydrocarbon radicals having a total of not less than 4 carbon atoms, or mixtures of such compounds, which adducts contain acid ether groups or, preferably, acid ester groups of inorganic or organic acids. These acid ethers or esters can be in the form of the free acids or salts, e.g. alkali metal salts, alkaline earth metal salts, ammonium or amine salts.

These anionic surfactants are obtained by known methods, by addition of at least 1 mol, preferably of more than 1 mol, e.g. 2 to 60 mol, of ethylene oxide or propylene oxide, or alternately, in any order, ethylene oxide and propylene oxide, to the above organic compounds, and subsequently etherifying or esterifying the adducts, and, if desired, converting the ethers or esters into their salts. Suitable starting materials are e.g. higher fatty alcohols, i.e. alkanols or alkenols, each containing 8 to 22 carbon atoms, dihydric to hexabydric aliphatic alcohols containing 2 to 9 carbon atoms, alicyclic alcohols, phenylphenols, benzylphenols, alkylphenols containing one or more alkyl substituents which together contain at least 4 carbon atoms, fatty acids containing 8 to 22 carbon atoms, amines which contain aliphatic and/or cycloaliphatic hydrocarbon radicals having not less than 8 carbon atoms, especially fatty amines containing such radicals, hydroxyalkylamines, hydroxyalkylamides and aminoalkyl esters of fatty acids or dicarboxylic acids and higher alkylated aryloxycarboxylic acids.

Very suitable anionic surfactants are acid esters, or salts thereof, of a polyadduct of 2 to 30 mol of ethylene oxide with 1 mol of a fatty alcohol containing 8 to 22 carbon atoms, or with 1 mol of a phenol which contains at least one benzyl group, one phenyl group or preferably one alkyl group containing not less than 4 carbon atoms, e.g. benzylpbenol, dibenzylphenol, dibenzyl(nonyl)pbenol, α-methylbenzylpbenol, bis(α-methylbenzyl)phenol, tris(α-methylbenzyl)phenol, o-phenylphenol, butylphenol, tributylphenol, octylphenol, nonylpbenol, dodecylphenol or pentadecylphenol. Particularly suitable anionic surfactants are those of formula $$R—O—(CH_2CH_2O)_mX, \quad (1)$$

wherein R is alkyl or alkenyl, each of 8 to 22 carbon atoms, alkylphenyl containing 4 to 16 carbon atoms in the alkyl moiety, or o-pbenylpbenyl, X is the acid radical of an inorganic oxygen-containing acid, for example phosphoric acid or, preferably, sulfuric acid, or is also the radical of an organic acid for example maleic acid, succinic acid or sulfosuccinic acid, and m is 2 to 30, preferably 2 to 15; and, in particular, those of formula $$R_1—O—(CH_2CH_2O)_mX_1 \quad (2)$$

wherein $R_1$ is alkyl or alkenyl, each of 8 to 22 carbon atoms, $X_1$ is carboxyalkyl containing 1 to 3 carbon atoms in the alkyl moiety, for example carboxymethyl, carboxyethyl or carboxypropyl, and m is 2 to 30, preferably 2 to 15.

The alkyl moiety of alkylphenyl is preferably in para-position. The alkyl moieties of alkylphenyl may be butyl, hexyl, n-octyl, n-nonyl, p-tertoctyl, p-isononyl, decyl or dodecyl. Alkyl radicals of 8 to 12 carbon atoms are preferred, octyl or nonyl radicals being most preferred.

The fatty alcobols for preparing the anionic surfactants of formulae (1) and (2) are, for example, those containing 8 to 22, preferably 8 to 18, carbon atoms, for example octyl, decyl, lauryl, tridecyl, myristyl, cetyl, stearyl, oleyl, arachidyl or behenyl alcohol.

The acid radical X is derived, for example, from a low molecular dicarboxylic acid, e.g. from maleic acid, succinic acid or sulfosuccinic acid, and is linked to the oxyetbylene part of the molecule through an ester bridge. In particular, X is derived from an inorganic polybasic acid such as sulfuric acid and, in particular, orthophosphoric acid. The acid radical X can be in salt form, i.e. for example in the form of an alkali metal salt, ammonium salt or amine salt. Examples of such salts are: lithium, sodium, potassium, ammonium, trimethylamine, ethanolamine, diethanolamine or triethanolamine salts.

Anionic surfactants of formula (2) are prepared in a manner which is known per se, for example by reacting an ethoxylated fatty alcohol with a halogenated lower carboxylic acid of 2 to 4 carbon atoms in the presence of, for example, aqueous sodium hydroxide. They can also be used in the form of their salts, for example as alkali metal salts, ammonium salts or amine salts. Examples of such salts are lithium, sodium, potassium, ammonium, trimetbylamine, ethanolamine, diethanolamine or triethanolamine salts. The sodium salts are preferred.

Suitable nonionic surfactants are polyadducts of 4 to 100 mol of alkylene oxide, for example ethylene oxide or propylene oxide, with 1 mol of an aliphatic monoalcohol containing not less than 4 carbon atoms, of a trihydric to hexahydric aliphatic alcohol, of a phenol or alkyl-, benzyl- or phenyl-substituted phenol or of a $C_8$–$C_{22}$fatty alcohol. Preferred nonionic surfactants are polyadducts Of $C_8$–$C_{22}$monoalcobols with 8 to 40 mol of ethylene oxide. Some of the polyadducts may be terminally etherified with alkyl groups of preferably 1 to 5 carbon atoms.

Such terminally blocked surfactants may be prepared in a manner which is known per se, for example by reacting the alkylene oxide adducts with thionyl chloride and subsequently reacting the resultant chloro compound with a fatty alcohol or short-chain alcohol.

The aliphatic monoalcohols may be, for example, water-insoluble monoalcohols of preferably 8 to 22 carbon atoms. These alcobols may be saturated or unsaturated and branched or straight chain, and may be used singly or in admixture. Natural alcohols such as myristyl alcohol, cetyl alcohol, stearyl alcohol or oleyl alcohol, or synthetic alcohols such as preferably 2-ethylhexanol, also trimethylhexanol, trimethylnonyl alcohol, hexadecyl alcohol or linear primary alcohols containing on average 8–10, 10–14, 12, 16, 18 or 20–22 carbon atoms, can be reacted with the alkylene oxide, preferably ethylene oxide.

Further aliphatic alcohols which can be reacted with alkylene oxide are trihydric to hexabydric alkanols. These alcohols contain 3 to 6 carbon atoms and are, in particular, glycerol, trimethylolpropane, erythritol, mannitol, pentaerythritol and sorbitol. The tribydric to bexahydric alcohols are preferably reacted with propylene oxide or ethylene oxide or with a mixture thereof.

Examples of unsubstituted or substituted phenols are phenol, α-methylbenzyl phenol, bis(α-methylbenzyl)-phenol, tris(α-methylbenzyl)phenol, o-phenylphenol or alkylphenols which contain 1 to 16, preferably 4 to 12, carbon atoms in the alkyl moiety. Examples of these alkylphenols are p-cresol, butyl phenol, tributyl phenol, octyl phenol and, preferably, nonyl phenol.

The fatty acids preferably contain 8 to 22 carbon atoms and may be saturated or unsaturated. They are typically capric, lauric, myristic, palmitic or stearic acid, and decenoic, dodecenoic, tetradecenoic, hexadecenoic, oleic, linoleic, linolenic or, preferably, ricinolic acid.

Examples of suitable nonionic surfactants are:

polyadducts of preferably 4 to 30 mol of alkylene oxide, in particular ethylene oxide, in which adducts individual ethylene oxide units may be replaced by substituted epoxides, such as styrene oxide and/or propylene oxide, with higher unsaturated or saturated monoalcohols, fatty acids, fatty amines or fatty amides of 8 to 22 carbon atoms or with pbenylphenol, α-methylbenzylphenol, bis(α-methylbenzyl)pbenol, tris(α-methylbenzyl)pbenol or alkylphenols whose alkyl moieties contain not less than 4 carbon atoms;

alkylene oxide, in particular ethylene oxide and/or propylene oxide condensates;

reaction products of a fatty acid of 8 to 22 carbon atoms and a primary or secondary amine having at least one hydroxy(lower alkyl) or (lower alkoxy)(lower alkyl) group, or adducts of alkylene oxide with these hydroxyalkylated reaction products, the reaction taking place such that the molecular ratio of hydroxyalkylamine to fatty acid may be 1:1 or greater than 1, for example 1:1 to 2:1;

polyadducts of propylene oxide with a trihydric to hexahydric aliphatic alcohol of 3 to 6 carbon atoms, for example glycerol or pentaerythritol, said polypropylene oxide adducts having an average molecular weight of 250 to 1800, preferably 400 to 900; and esters of polyalcohols, preferably mono- or diglycerides of $C_{12}$–$C_{18}$-fatty acids, for example monoglycerides of lauric, stearic or oleic acid.

Very suitable nonionic surfactants are polyadducts of 10 to 15 mol of ethylene oxide with 1 mol of fatty alcohol or fatty acid, each containing 8 to 22 carbon atoms, or with 1 mol of alkylphenol containing a total of 4 to 12 carbon atoms in the alkyl moiety or, more particularly, fatty acid diethanolamides containing 8 to 22 carbon atoms in the fatty acid radical, most preferably lauryl diethanolamide or coconut fatty acid diethanolamide.

Suitable nonionic surfactants are also those of the amine oxide or sulfoxide type.

Suitable cationic surfactants are compounds which contain amino, imino, quaternary ammonium or immonium groups, tertiary phosphino, quaternary phosphonium or sulfonium groups, and also thiouronium or guanidium groups, as basic substituents. Preferred cationic surfactants are fatty amines and acid salts thereof or quaternary ammonium compounds each containing not less than one aliphatic hydrocarbon radical of 6 to 22 carbon atoms which may be interrupted by oxygen atoms.

Further suitable cationic surfactants are monoamines or polyamines containing two or more, preferably two to five, basic nitrogen atoms, which amines contain at least one polyglycol ether chain and at least one lipophilic substituent, for example alkyl or alkenyl, each of 8 to 22 carbon atoms, and which may be partially or completely quaternised.

Yet further cationic surfactants are N-alkylated cyclic ammonium compounds, for example derived from unsaturated heterocyclic compounds such as pyridinium, quinolinium, isoquinolinium, phthalazinium, benzimidazolium, benzothiazolium, benzotriazolium and imidazolinium derivatives, or from saturated beterocyclic compounds such as pyrrolidinium, piperidinium, morpholinium, thiamorpholinium, piperazinium, 1,3-benzoxazinium, 1,3,5-trialkylhexahydro-1,3,5-triazinium and N-hexahydroazepinium derivatives. Such surfactants are described, for example, in E. Jungermann, Cationic Surfactants, Marcel Dekker Inc., New York and Basel, 1970, page 71 et seq.

Suitable cationic surfactants are also polyammonium polymers, for example those described in U.S. Pat. Nos. 4,247,476 and 4,349,532.

Suitable amphoteric surfactants are, for example, carboxy derivatives of imidazole, carboxybetaines, sulfobetaines, sulfoniobetaines and phosphonobetaines, as well as other phosphorus-containing betaines. Such surfactants are described in B. R. Bluestein and C. L. Hilton, "Amphoteric Surfactants", Marcel Dekker, Inc., New York and Basel, 1982, pages 1-173.

Examples of further amphoteric surfactants are those of the amino acid type containing carboxyl, sulfonate or sulfate anions, for example the N-fatty amine propionates, the asparagine derivatives, the alkyl dimethyl ammonium acetates, the fatty alkyl dimethyl carboxymethylammonium salts and monoamines or polyamines containing two or more, preferably two to five, basic nitrogen atoms, which amines contain, per basic nitrogen atom, at least one acid etherified or esterified polyglycol ether chain and at least one lipophilic substituent, and which may in addition be partially or completely quaternised (q.v. B. R. Bluestein and C. L. Hilton, op. cit., pages 175-228).

Suitable hydrophobic capillary materials are mainly fibre materials. They may, however, also be materials in powder form.

Fibre materials which may suitably be treated with the compositions of this invention are synthetic fibres, for example polyamide, polyester, acrylic, polypropylene, polycarbonate, polyurethane-elastomer fibres, regenerated cellulose fibres, or natural fibres such as raw cotton, flax, wool and silk.

Polyamide fibres will be understood as meaning synthetic polyamide fibre material, for example polyamide 6, polyamide 66 or polyamide 12.

Polyester fibres will be understood as meaning preferably man-made high molecular weight fibres made from linear aromatic polyesters (usually polycondensates of terephthalic acid and glycols, especially ethylene glycol, or polycondensates or terephthalic acid and 1,4-bis(hydroxymethyl)hexahydrobenzene.

Acrylic fibres will be understood as meaning, for example, fibres which contain not less than 85% of polymerised acrylonitrile. Such acrylic fibres normally consist of ternary copolymers and 85-95% of acrylonitrile, 4-10% of a nonionic comonomer and 0.5-1% of an ionic comonomer containing a sulfo or sulfonate group.

Polycarbonate fibres are mainly bomo- and copolymer polycarbonates, for example the polymer of bisphenol A and phosgene.

Polyurethane-elastomer fibres will be understood as meaning, for example, the elastic fibres which are obtained by reacting low molecular diisocyanates with long-chain, low-melting dihydroxy compounds, for example copolyesters of adipic acid and a mixture of diols, for example of ethylene glycol and 1,2-propanediol or 1,6-hexanediol.

Polypropylene fibres will be understood as meaning in particular fibres which consists of homopolymers of propylene and copolymers of propylene and other aliphatic 1-olefins of 2 to 8 carbon atoms.

Examples of materials in powder form which may be treated with the compositions of this invention are activated carbon and vat and disperse dyes.

The compositions of this invention may contain further ingredients such as antifoams, viscosity regulators, electrolytes or preservatives.

Suitable antifoams are, for example, those disclosed in DE-B- 26 25 706. They may also be, however, those based on silicone oil, or alkylene diamides containing amide groups of formula RCONH—, wherein R is an aliphatic or cycloaliphatic radical such as $C_9$-$C_{23}$alkyl or cyclohexyl. Further antifoams are described in German Offenlegungsscbrift 1 519 967 or European patent application 207 002. Preferred antifoams are those based on silicone oils.

The compositions of this invention are prepared by mixing the water-soluble surfactant with water, with or without the application of heat, and adding to the homogeneous solution the very slightly water-soluble amphiphilic compound and also the optional antifoam.

The compositions of this invention contain the water-soluble surfactants and the amphiphilic organic compound in a weight ratio of 20:1 to 1:1, preferably of 10:1 to 2:1.

The compositions of this invention may be used undiluted or diluted with water. Application baths for the treatment of textiles may contain 0.01 to 50 g/l, preferably 3 to 20 g/l and, most preferably, 3 to 5 g/l, of the composition.

Preferred compositions comprise:

10-60% by weight, preferably 10-50% by weight, of water-soluble surfactant, 2-10% by weight of amphiphilic organic compound, preferably in liquid form, 0.2-2% by weight of antifoam, 87.8-38% by weight of water.

The invention is illustrated in more detail by the following Examples, in which parts and percentages are by weight.

PREPARATORY EXAMPLES

Example 1

50 parts of sodium dodecylbenzene sulfonate are mixed with 36.25 parts of water while heating to 50°-600C., and the mixture is homogenised by stirring. To the homogeneous solution are then added 12.5 parts of tributyl citrate and 1.25 parts of antifoam consisting for example of 85% of silicone oil and 15% of pyrogenic silicic acid. A highly viscous liquid is obtained.

Example 2

20 parts of lauryl diethanolamide are mixed at 50°-60° C. with 74.5 parts of water, and the mixture is homogenised by stirring. To the homogeneous solution are then added 5 parts of tributyl citrate and 0.5 part of antifoam according to Example 1. A pourable, storage-stable liquid is obtained.

Example 3

20 parts of hexadecylpyridinium chloride are mixed at 50°-60° C. with 75 parts of water, and the mixture is homogenised by stirring. To the homogeneous solution are then added 5 parts of tributyl citrate. A viscous, storage-stable liquid is obtained.

Comparably good formulations are obtained by using in Example 1 to 3 instead of tributyl citrate, 5 parts of tetrabutyl urea, tributylamine, bis(2-ethylhexyl)amine, dibutylaminoethanol or geraniol.

Example 4

50 parts of sodium dodecylbenzene sulfonate are mixed at 50°-60°C. with 37.5 parts of water, and the mixture is homogenised by stirring. To the homogeneous solution are then added 12.5 parts of tetrabutyl urea. A highly viscous solution is obtained.

Example 5

60 parts of the carboxymethylated adduct of 5 mol of ethylene oxide with 1 mol of lauryl alcohol are mixed with 26 parts of water, and the mixture is homogenised by stirring. To the homogeneous solution are added, in succession, 8 parts of tributyl citrate, 1 part of the antifoam according to Example 1, and 5 parts of 2-methyl-2,4-pentanediol. A viscous, storage-stable formulation is obtained.

Example 6

30 parts of coconut fatty acid diethanolamide are mixed with 10 parts of the carboxymethylated adduct of 2.5 mol of ethylene oxide with 1 mol of lauryl alcohol and 45.9 parts of water, and the mixture is homogenised by stirring. With stirring, 3.5 parts of tributyl citrate, 0.6 part of the antifoam according to Example 1 and 10 parts of an aqueous mixture of the mixture of oligomers of phosphoric acid esters disclosed in U.S. Pat. No. 4 254 063, sodium gluconate and magnesium chloride (in the ratio of 2:1:1) are then added. A viscous, storage-stable formulation is obtained.

Example 7

30 parts of coconut fatty acid diethanolamide are mixed with 10 parts of the carboxymethylated adduct of 2.5 mol of ethylene oxide with 1 mol of lauryl alcohol and 27.9 parts of water, and the mixture is homogenised by stirring. With constant stirring, 3.5 parts of tributyl citrate, 0.6 part of the antifoam according to Example 1, 10 parts of the mixture of oligomers of phosphoric acid esters disclosed in U.S. Pat. No. 4,254,063, 11 parts of 50% KOH and 7 parts of a 70% solution of sorbitol are then added in succession. A viscous, storage-stable formulation is obtained.

Example 8

30 parts of coconut fatty acid diethanolamide are mixed with 10 parts of the carboxymethylated adduct of 2.5 mol of ethylene oxide with 1 mol of lauryl alcohol and 54.5 parts of water, and the mixture is homogenised by stirring. Then 4.5 parts of acetyl tributyl citrate and 1 parts of the antifoam according to Example 1 are added in succession. A viscous, storage-stable formulation is obtained.

Example 9

The procedure of Example 8 is repeated, using 4.5 parts of tetrabutyl urea in place of acetyl tributyl citrate. A viscous, storage-stable formulation is obtained.

Example 10

30 parts of coconut fatty acid diethanolamide are mixed with 10 parts of the carboxymethylated adduct of 2.5 mol of ethylene oxide with 1 mol of lauryl alcohol and 49.5 parts of water, and the mixture is homogenised by stirring. Then 4.5 parts of tributyl citrate, and 5 parts of an antifoam consisting of 47 parts of butyl acrylate/2-ethylhexyl maleate, 39 parts of isopalmityl alcohol, 7 parts of an ethoxylated polydimethyl siloxane, 3.5 parts of the polyadduct of 9 mol of ethylene oxide and 1 mol of styrene oxide with 1 mol Of $C_{13}$oxoalcobol and 3.5 parts of oleic acid are added. A viscous, storage-stable formulation is obtained.

Example 11

The procedure of Example 10 is repeated, replacing the antifoam used therein by 5 parts of a formulation comprising 1.65 parts of N,N'-ethylenebis(stearamide), 2 parts of magnesium stearate, 37 parts of bis(2-ethylhexyl)maleate, 37.35 parts of paraffin oil (Shelloil L 6189), 11 parts of a nonionic emulsifier, for example Tween 65 ® and 11 parts of an anionic emulsifier, for example Phospholan PNP9°. A viscous, storage-stable formulation is obtained.

Example 12

25 parts of the polyadduct (OH-127) of 4 mol of ethylene oxide and 1 mol of styrene oxide with 1 mol of $C_9$—$C_{11}$oxoalcohol are mixed with 72 parts of water and the mixture is homogenised by stirring. Then 2.5 parts of tributyl citrate and 0.5 part of a silicone antifoam are added in succession. A low viscosity, storage-stable formulation is obtained.

Example 13

25 parts of the maleic acid monoester of the polyadduct of 35 mol of ethylene oxide and 1 mol of styrene oxide with 1 mol of stearyl alcohol are mixed with 72 parts of water, and the mixture is homogenised by stirring. Then 2.5 parts of tributyl citrate and 0.5 part of a silicone antifoam are added in succession. A viscous, storage-stable formulation is obtained.

Example 14

20 parts of lauryl diethanolamide and 5 parts of the carboxymethylated adduct of 10 mol of ethylene oxide with 1 mol of lauryl alcohol are mixed at 50° C. with 59 parts of water, and the mixture is homogenised by stirring. To the homogeneous solution are then added, in succession, 5 parts of tributyl citrate, 1 part of the antifoam according to Example 1, 5 parts of polyethylene glycol 400 and 5 parts of 2-methyl-2,4-pentandiol. A viscous, storage-stable formulation is obtained.

USE EXAMPLES

Example A

A starch-sized raw cotton fabric is desized by padding it with an aqueous liquor which contains the following ingredients:

1 g/l of enzymatic desizing agent, for example amylase,
4 g/l of sodium chloride, and
3 g/l of the formulation of Example 2.

The fabric is expressed to a pick-up of 100% and stored for 2 hours at 80° C. The fabric is then rinsed in conventional manner with warm and cold water and thereafter dried.

To test the quality of the desizing, the fabric is treated with a solution of iodine/potassium iodide. The blue coloration which occurs if starch size is still present is assessed.

The fabric is rapidly wetted and completely deaerated by addition of the formulation of Example 2.

Example B

To dye a cotton knitted fabric, the material is padded at a temperature of 20°-30° C. and for an immersion time of 3-5 seconds, and expressed to a pick-up of 100%.

The padding liquor contains the following ingredients:

18 g/l of the dye of formula

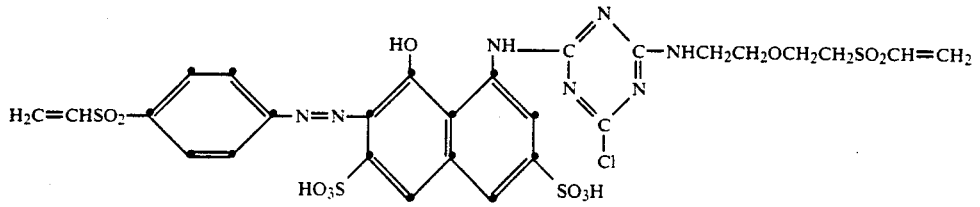

5 g/l of the formulation of Example 4, 5 g/l of the graft polymer prepared according to Instruction 2 of European patent application 111 454, as binder for the liquor, 2 g/l of a dispersant, for example sulfonaphthalene/formaldehyde condensate, 3 g/l of sodium m-nitrobenzenesulfonate, 70 ml/l of water glass of 37°-40° Bé, and 18 ml/l of aqueous sodium hydroxide solution of 36° Bé.

The knitted fabric is stored at 20°-30° C. for 8 hours, during which time the dye is fixed.

The fabric is rapidly wetted and deaerated by addition of the formulation of Example 4. A level and fast dyeing is obtained on the treated cotton.

Example C

A raw cotton yarn package is put into a circulation dyeing machine which contains 3 g/l of an aqueous warm formulation of 30° C. of the wetting agent obtained in Example 2.

The package is rapidly wetted through and deaerated by the strong wetting and deaerating action of the formulation and can be dyed in conventional manner, at a liquor ratio of 1:40, with a dye liquor comprising:

7 g/kg of a vat dye consisting of a mixture of Vat Blue 4 C.I. 69 800 and Vat Blue 6 C.I. 69 825 in the ratio 1:3, 2 g/l of a fatty alkylbenzimidazole sulfonate, 9 g/l of sodium hydrosulfite, and 25 ml/l of 30% aqueous sodium hydroxide solution.

After homogeneous dispersion of the ingredients, the dye liquor is heated to 60° C. over 30 minutes and the cotton yarn is dyed for 60 minutes at this temperature. The goods are then oxidised, soaped, rinsed and dried in conventional manner. The yarn package is rapidly wetted and completely deaerated by addition of the formulation of Example 2, to give a uniform dye penetration of the package.

Example D

To bleach a raw cotton fabric, the substrate is padded at room temperature and for an immersion time of 3 to 5 seconds and expressed to a pick-up of 95%. The bleaching bath contains the following ingredients:

10 ml/l of sodium silicate solution of 38° Bé, 5 g/l of the formulation of Example 11, 75 ml/l of sodium hydroxide solution of 36° Bé, 60 ml/l of hydrogen peroxide, and 5 g/l of sodium persulfate.

The fabric is stored for 16 hours at 25°-30° C. and thereafter washed with hot and cold water and neutralised.

The addition of the wetting agent of Example 11 effects a homogeneous and complete wetting of the fabric.

The uniformly bleached fabric so obtained has an enhanced degree of whiteness, from −72 to 47 measured by the CIBA-GEIGY Whiteness Scale, and the average degree of polymerisation of the cotton (DP) falls only from 2740 to 2530, and the degree of desizing according to TEGEWA is enhanced from rating 1 to rating 4.

What is claimed is:

1. A composition for wetting hydrophobic capillary materials, which composition consists essentially of:

(a) a water-soluble nonionic surfactant selected from the group consisting of ($a_1$) polyadducts of 4 to 30 mols of alkylene oxide with higher monoalcohols, fatty acids, fatty amines or fatty amides of 8 to 22 carbon atoms and ($a_2$) reaction products of fatty acids of 8 to 22 carbon atoms and primary or secondary amines having at least one hydroxy(lower alkyl) or (lower alkoxy)(lower alkyl) group, (b) tributyl citrate, (c) a water-soluble anionic surfactant and (d) water.

2. A composition according to claim 1, wherein the anionic surfactant is a compound of the formula $$R_1—O—(CH_2CH_2O)_m—X_1$$

wherein $R_1$ is alkyl or alkenyl, each of 8 to 22 carbon atoms, $X_1$ is carboxyalkyl containing 1 to 3 carbon atoms in the alkyl moiety, and m is 2 to 30.

3. A composition according to claim 1, wherein the anionic surfactant is a compound of the formula $$R—O—(CH_2CH_2O)_m—X$$

wherein R is alkyl or alkenyl, each of 8 to 22 carbon atoms, alkylphenyl containing 4 to 16 carbon atoms in the alkyl moiety, or o-pbenylpbenyl, X is the acid radical of phosphoric acid or sulfuric acid or the radical of an organic acid and m is 2 to 30.

4. A process for wetting hydrophobic capillary material, which comprises treating said material with a composition as defined in claim 1.

5. A composition according to claim 1, wherein the water-soluble anionic surfactant is an alkarylsulfonate with linear or branched alkyl chain containing not less than 6 carbon atoms.

6. A composition according to claim 5, wherein the water-soluble anionic surfactant is dodecylbenzosulfonate.

7. A composition according to claim 5, wherein the water-soluble anionic surfactant is 3,7-diisobutylnaphthalenesulfonate.

8. A composition according to claim 1, which contains the water-soluble surfactants (a) and (c) and component(b) in a weight ratio of 20:1 to 1:1.

* * * * *